US007911298B2

(12) United States Patent
Carlino et al.

(10) Patent No.: US 7,911,298 B2
(45) Date of Patent: Mar. 22, 2011

(54) ELECTRICAL SWITCHING APPARATUS AND TRIP ACTUATOR ASSEMBLY THEREFOR

(75) Inventors: Harry J. Carlino, Export, PA (US); Lloyd A. Maloney, Beaver, PA (US); Joseph B. Humbert, Monaca, PA (US); Martha Suryani, Coraopolis, PA (US)

(73) Assignee: Eaton Corporation, Cleveland, OH (US)

( * ) Notice: Subject to any disclaimer, the term of this patent is extended or adjusted under 35 U.S.C. 154(b) by 211 days.

(21) Appl. No.: 12/247,555

(22) Filed: Oct. 8, 2008

(65) Prior Publication Data

US 2010/0085136 A1 Apr. 8, 2010

(51) Int. Cl.
*H01H 73/12* (2006.01)

(52) U.S. Cl. ..... 335/18; 335/172

(58) Field of Classification Search ..... 335/167–180, 335/16–18; 200/310, 314, 317
See application file for complete search history.

(56) References Cited

U.S. PATENT DOCUMENTS 5,341,191 A 8/1994 Crookston et al.
5,910,760 A 6/1999 Malingowski et al.
6,144,271 A 11/2000 Mueller et al.
6,441,708 B1 * 8/2002 Rodriguez et al. ..... 335/172
6,853,279 B1 2/2005 Puskar et al.
6,949,997 B2 * 9/2005 Bergh et al. ..... 335/78
7,106,155 B2 9/2006 Turner et al.
7,405,640 B2 * 7/2008 McCoy ..... 335/6
2002/0158726 A1 * 10/2002 Wellner et al. ..... 335/18
2003/0043004 A1 * 3/2003 Chu ..... 335/172

* cited by examiner

*Primary Examiner* — Anh T Mai
*Assistant Examiner* — Bernard Rojas
(74) *Attorney, Agent, or Firm* — Martin J. Moran

(57) ABSTRACT

A trip actuator assembly is provided for an electrical switching apparatus, such as a circuit breaker. The trip actuator assembly includes a trip actuator with an actuating element, which is movable among unactuated and actuated positions corresponding to separable contacts of the circuit breaker being closeable and tripped opened in response to a trip condition, respectively. The trip actuator is disposed at a mounting portion of a frame. An interface assembly is movably coupled to the frame and includes an interface element disposed between the actuating element of the trip actuator and a portion of the circuit breaker operating mechanism. When the actuating element moves from the unactuated position toward the actuated position, it engages and moves the interface element, thereby moving the operating mechanism to trip open the separable contacts. The frame secures the trip actuator assembly in a desired orientation within a corresponding one of the housing compartments.

9 Claims, 4 Drawing Sheets

ELECTRICAL SWITCHING APPARATUS AND TRIP ACTUATOR ASSEMBLY THEREFOR

BACKGROUND OF THE INVENTION

1. Field of the Invention

This invention relates generally to electrical switching apparatus and, more particularly, to electrical switching apparatus, such as circuit breakers. The invention also relates to trip actuator assemblies for circuit breakers.

2. Background Information

Electrical switching apparatus include, for example, circuit switching devices; circuit interrupters, such as circuit breakers; network protectors; contactors; motor starters; motor controllers; and other load controllers. Electrical switching apparatus such as circuit interrupters and, in particular, circuit breakers of the molded case variety, are well known in the art. See, for example, U.S. Pat. No. 5,341,191.

Circuit breakers are used to protect electrical circuitry from damage due to an overcurrent condition, such as an overload condition or a relatively high level short circuit or fault condition. Molded case circuit breakers typically include a pair of separable contacts per phase. The separable contacts may be operated either manually by way of a handle disposed on the outside of the case or automatically in response to an overcurrent condition. Typically, such circuit breakers include an operating mechanism, which is designed to rapidly open and close the separable contacts, a trip unit, which senses overcurrent conditions in an automatic mode of operation, and a trip actuator assembly, which in response to such overcurrent conditions, is actuated by the trip unit to move the operating mechanism to a trip state, thereby moving the separable contacts to their open position. See, for example, U.S. Pat. Nos. 5,910,760; and 6,144,271.

It is sometimes desirable to integrate a new trip unit feature or a new or different type of trip unit into a circuit breaker. For example, it is sometimes desirable to integrate an electronic trip mechanism (e.g., without limitation, a flux shunt trip actuator) into the trip actuator assembly. Whether this is done during the assembly of a new circuit breaker or as a retrofit of an existing circuit breaker, it typically requires that numerous components be fit within the circuit breaker housing, where space is limited. Effectively arranging the trip actuator assembly within the circuit breaker housing such that it works well, yet does not require relatively significant modifications or alterations to the housing or to the circuit breaker in general, is a challenging endeavor.

There is, therefore, room for improvement in electrical switching apparatus, such as circuit breakers, and in trip actuator assemblies therefor.

SUMMARY OF THE INVENTION

These needs and others are met by embodiments of the invention, which are directed to a trip actuator assembly for electrical switching apparatus such as, for example, circuit breakers, wherein the trip actuator assembly includes a frame and an interface assembly that enable the trip actuator assembly to operate effectively and to be secured in a desired orientation within a compartment of the circuit breaker housing.

As one aspect of the invention, a trip actuator assembly is provided for an electrical switching apparatus. The electrical switching apparatus comprises a housing, separable contacts enclosed by the housing, and an operating mechanism structured to open and close the separable contacts. The housing includes an exterior, an interior, and a number of compartments disposed within the interior. The trip actuator assembly comprises: a trip actuator comprising an actuating element, the actuating element being structured to move among an unactuated position corresponding to the separable contacts of the electrical switching apparatus being closeable, and an actuated position corresponding to the separable contacts being tripped opened in response to a trip condition; a frame comprising a first end, a second end disposed opposite and distal from the first end, and a mounting portion disposed between the first end and the second end, the trip actuator being disposed at or about the mounting portion of the frame; and an interface assembly movably coupled to the frame, the interface assembly comprising an interface element, the interface element being structured to be disposed between the actuating element of the trip actuator and a portion of the operating mechanism of the electrical switching apparatus. When the actuating element of the trip actuator moves from the unactuated position toward the actuated position in response to the trip condition, the actuating element engages and moves the interface element, thereby moving the operating mechanism to trip open the separable contacts. The frame is structured to secure the trip actuator assembly in a desired orientation within a corresponding one of the number of compartments of the housing.

The interface assembly may further comprise a reset member movably coupled to the frame. The reset member may include a first end structured to be accessible from the exterior of the housing of the electrical switching apparatus, and a second end disposed opposite and distal from the first end of the reset member. The second end of the reset member may be cooperable with the interface element to reset the actuating element of the trip actuator from the actuated position to the unactuated position. The reset member may be a reset button. The reset button may be movable among a first position corresponding to the second end of the reset button not engaging the interface element, and a second position corresponding to the second end of the reset button engaging and moving the interface element, thereby moving the actuating element of the trip actuator toward the unactuated position. The interface assembly may further comprise a biasing element. The biasing element may bias the reset button toward the first position.

The frame may further comprise a first trip actuator restraint and a second trip actuator restraint. The trip actuator may be restrained between the first trip actuator restraint and the second trip actuator restraint, and the mounting portion of the frame may overlay at least a portion of the trip actuator. The first trip actuator restraint may be a first projection extending perpendicularly outwardly from the first end of the frame, and the second trip actuator restraint may be a second projection extending perpendicularly outwardly from the second end of the frame generally opposite the first projection. The first projection may include a tapered end, wherein the tapered end of the first projection is structured to cooperate with a portion of the corresponding one of the number of compartments of the housing of the electrical switching apparatus.

As another aspect of the invention, an electrical switching apparatus comprises: a housing including an exterior, an interior, and a number of compartments disposed within the interior; separable contacts enclosed by the housing; an operating mechanism for opening and closing the separable contacts; and a trip actuator assembly comprising: a trip actuator comprising an actuating element, the actuating element being movable among an unactuated position corresponding to the separable contacts being closeable, and an actuated position corresponding to the separable contacts being tripped opened in response to a trip condition, a frame comprising a first end, a second end disposed opposite and distal from the first end, and a mounting portion disposed between the first end and the second end, the trip actuator being disposed at or about the mounting portion of the frame, and an interface assembly movably coupled to the frame, the interface assembly comprising an interface element, the interface element being disposed between the actuating element of the trip actuator and a portion of the operating mechanism. When the actuating element of the trip actuator moves from the unactuated position toward the actuated position in response to the trip condition, the actuating element engages and moves the interface element, thereby moving the operating mechanism to trip open the separable contacts. The frame secures the trip actuator assembly in a desired orientation within a corresponding one of the number of compartments of the housing.

The operating mechanism may further comprise a trip bar and a generally planar element extending outwardly from the trip bar, and the interface element may include an elongated protuberance. When the actuating element of the trip actuator moves toward the actuated position in response to the trip condition, the elongated protuberance of the interface element may engage and move the generally planar element, thereby pivoting the trip bar and tripping open the separable contacts.

The electrical switching apparatus may be a circuit breaker, and the operating mechanism of the circuit breaker may further comprise a trip unit module. The trip unit module may comprise a sensor structured to sense current flowing through the separable contacts, and a processor structured to output a trip signal to the trip actuator of the trip actuator assembly responsive to the sensed current. When the sensed current is indicative of the trip condition, the trip signal may actuate the actuating element of the trip actuator thereby moving the actuating element to the actuated position to trip open the separable contacts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
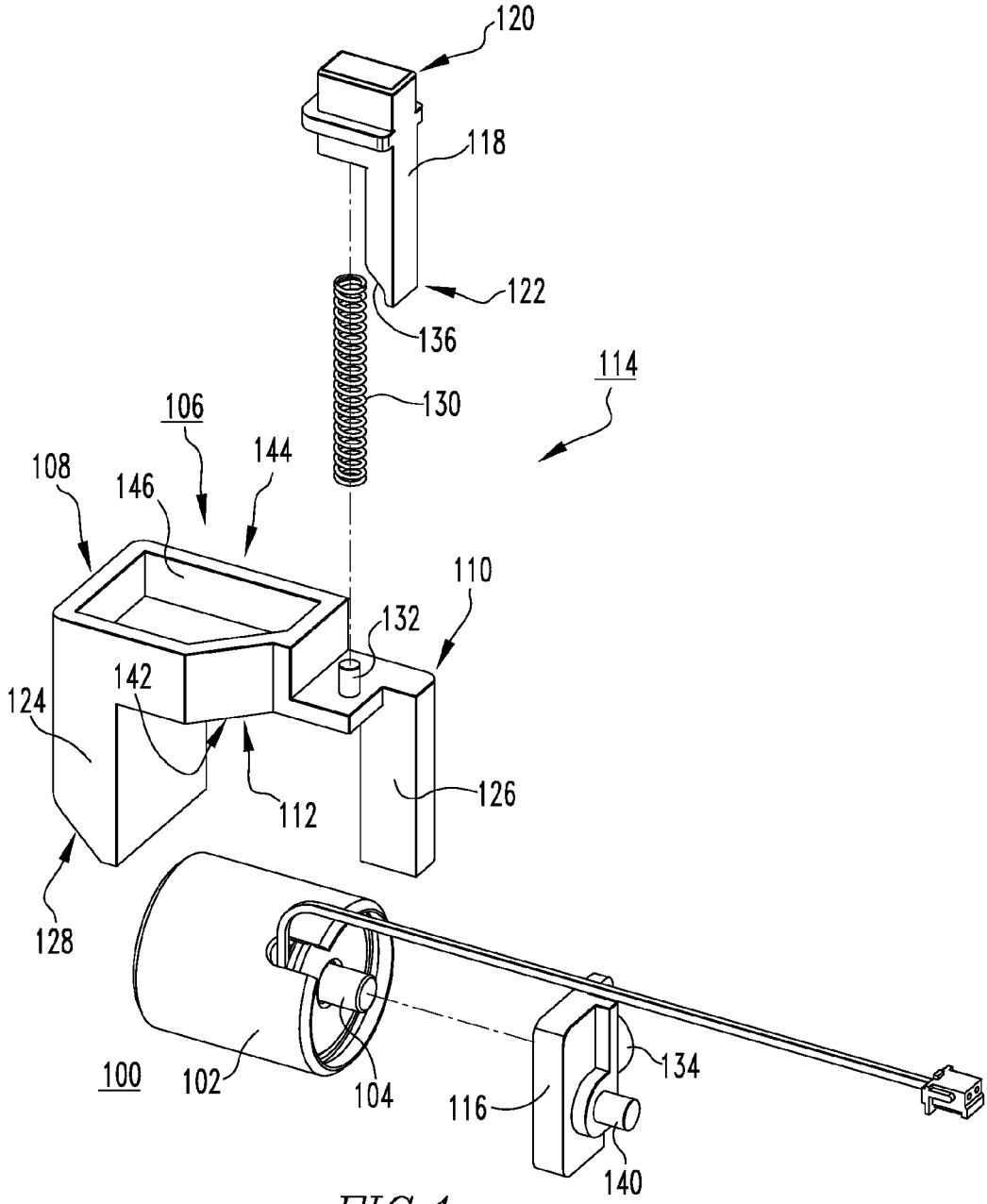
FIG. 1 is an exploded isometric view of a trip actuator assembly in accordance with an embodiment of the invention.

For purposes of illustration, embodiments of the invention are shown and described in association with a trip actuator for a trip unit of a three-pole circuit breaker, although it will become apparent that they are also applicable to a wide range of electrical switching apparatus having any number of poles.

Directional phrases used herein, such as, for example, left, right, top, bottom, up, down, clockwise and counterclockwise and derivatives thereof, relate to the orientation of the elements shown in the drawings and are not limiting upon the claims unless expressly recited therein.

As employed herein, the terms "actuator" and "actuating element" refer to any known or suitable output mechanism (e.g., without limitation, trip actuator; solenoid) for an electrical switching apparatus and/or the element (e.g., without limitation, stem; plunger; lever; paddle; arm) of such mechanism which moves in order to manipulate another component of the electrical switching apparatus.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the term "trip condition" refers to any electrical event that results in the initiation of a circuit breaker operation in which the separable contacts of the circuit breaker are tripped open, and expressly includes, but is not limited to, electrical fault conditions such as, for example, current overloads, short circuits, abnormal voltage and other fault conditions, receipt of an input trip signal, and a trip coil being energized.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
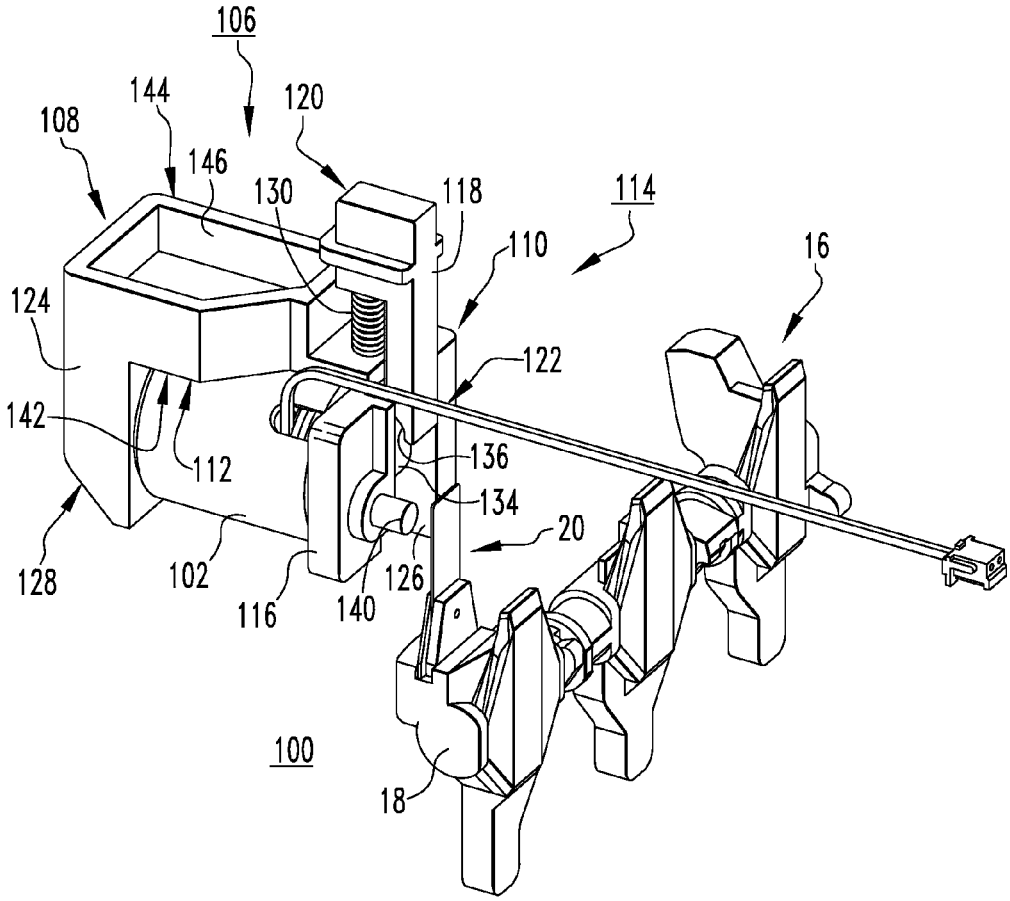
FIG. 2 is an assembled isometric view of the trip actuator assembly of FIG. 1, also showing a trip bar of a circuit breaker in accordance with an embodiment of the invention.
Figure 3:
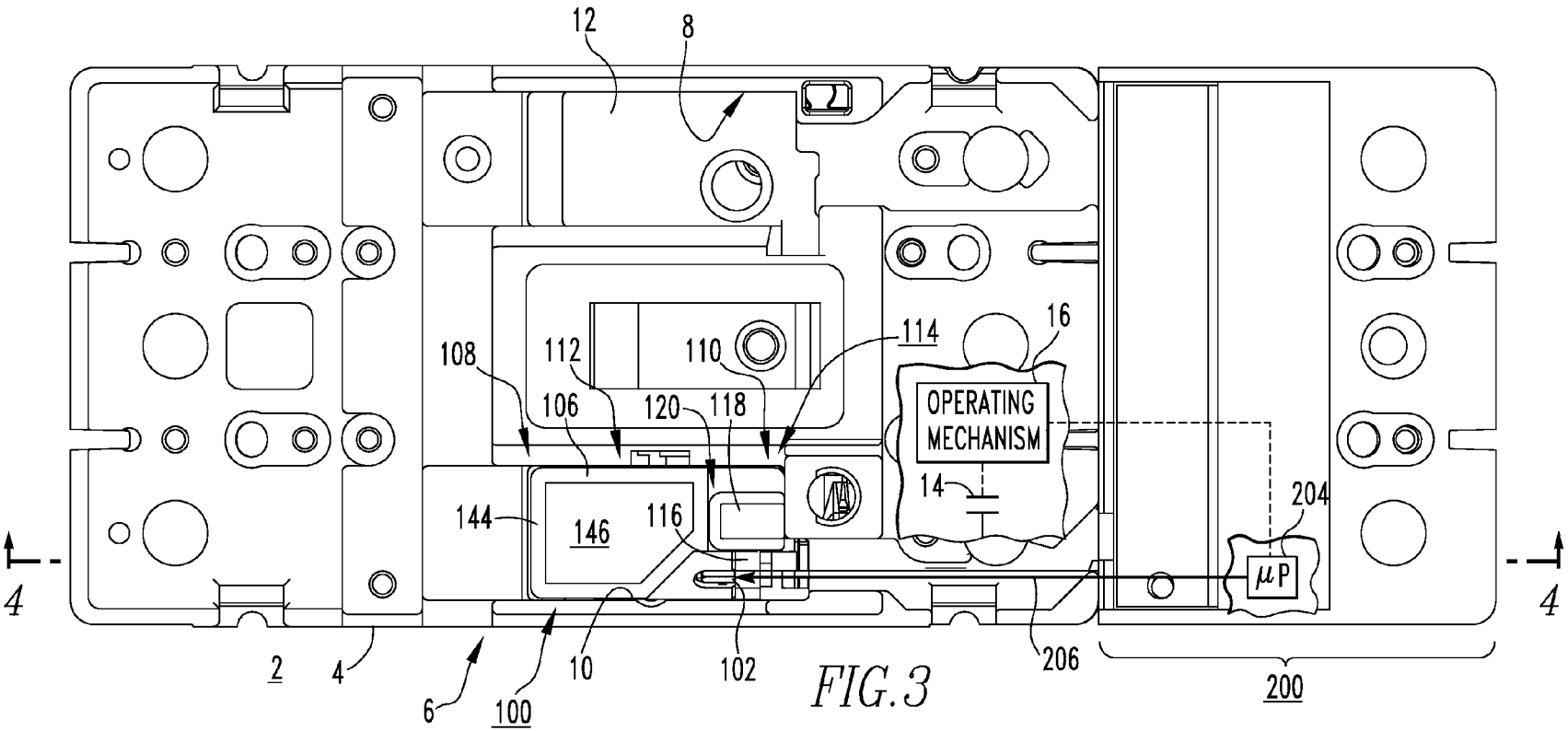
FIG. 3 is a top plan view of a circuit breaker employing the trip actuator assembly of FIG. 2.
Figure 4:
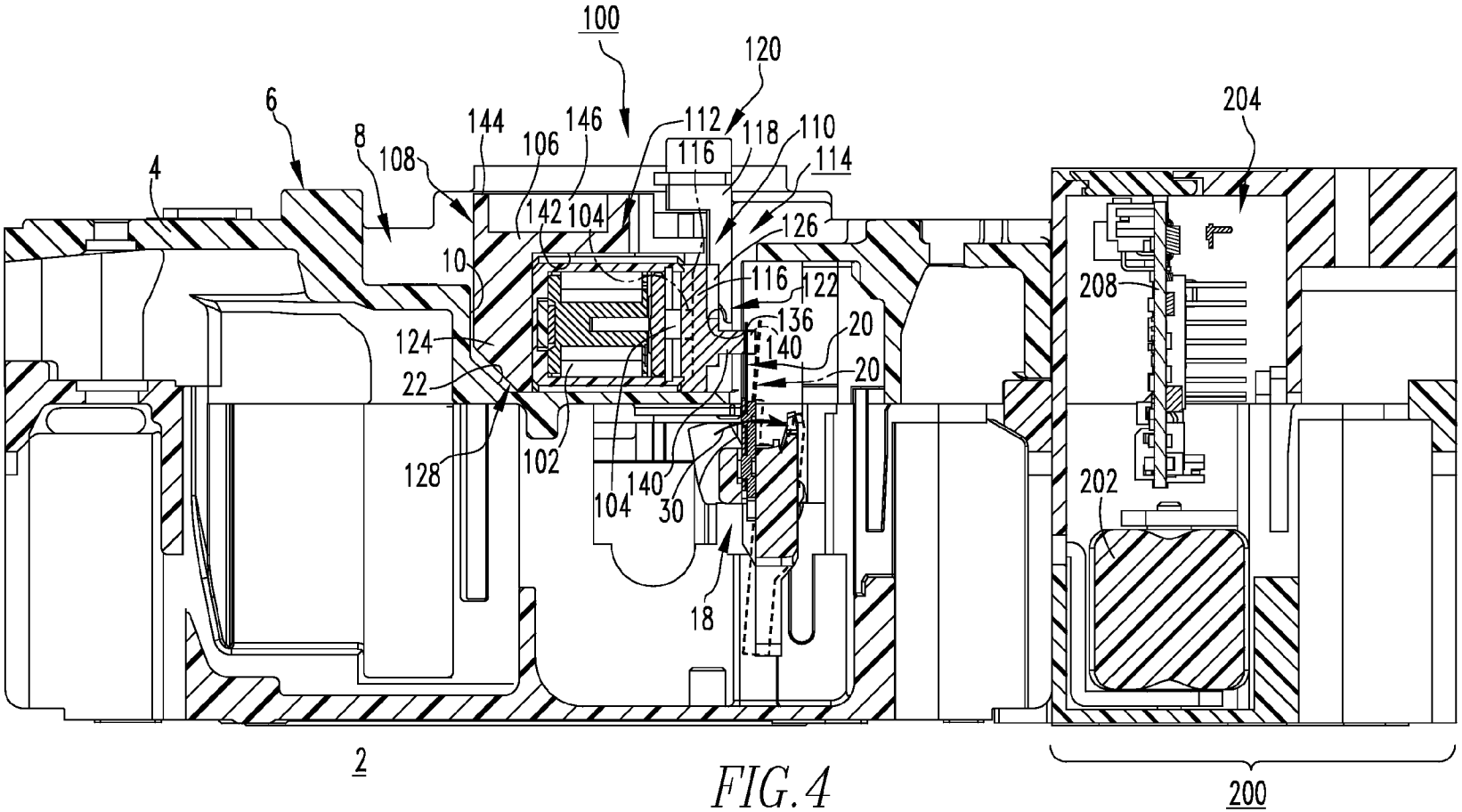
FIG. 4 is a sectional view taken along line 4-4 of FIG. 3.

FIGS. 1 and 2 show a trip actuator assembly 100 for an electrical switching apparatus such as, for example, a circuit breaker 2 which is shown in FIGS. 3 and 4. The circuit breaker 2 includes a housing 4 having an exterior 6, an interior 8, and a number of compartments (see, for example, compartments 10 and 12 of FIG. 3; one compartment 10 is shown in the sectional view of FIG. 4) disposed within the interior 8. Separable contacts 14 (shown in simplified form in FIG. 3) are enclosed by the housing 4, and an operating mechanism 16 (shown in simplified form in FIG. 3) is structured to open and close the separable contacts 14 (FIG. 3).

In the example of FIGS. 3 and 4, the operating mechanism 16 of the circuit breaker 2 includes a trip unit module 200, which is coupled to a corresponding end of the circuit breaker housing 4, as shown. The trip unit module 200 includes a number of sensors 202 (one is shown in FIG. 4) structured to sense current flowing through the separable contacts 14 (FIG. 3), and a processor (μP) 204 structured to output a trip signal (indicated generally by reference numeral 206 in FIG. 3) to a trip actuator 102 (e.g., without limitation, a solenoid) of the trip actuator assembly 100 responsive to the sensed current. It will be appreciated that the trip module unit 200 and/or the components (e.g., without limitation, sensor(s) 202; processor (μP) 204; printed circuit board 208 (FIG. 4)) thereof could have a wide variety of alternative configurations (not shown), without departing from the scope of the invention. It will also be appreciated that a suitable interface such as, for example and without limitation, a FET transistor (not shown) may be employed to suitably buffer the trip signal 206 provided by the processor (μP) 204 to the trip actuator 102. As will be discussed in greater detail hereinbelow, when the sensed current is indicative of a trip condition, as defined above, the trip signal 206 (FIG. 3) energizes the trip actuator 102, which actuates an actuating element 104 (e.g., without limitation, a plunger)

(FIG. 4), thereby moving the actuating element 104 to trip open the separable contacts 14 (FIG. 3) of the circuit breaker 2.

As best shown in FIGS. 1 and 2, the example trip actuator 102 is a solenoid having a plunger 104 as the actuating element. The actuating element 104 is movable among an unactuated position (FIG. 2) corresponding to the separable contacts 14 (FIG. 3) of the circuit breaker 2 (FIGS. 3 and 4) being closeable, and an actuated position (partially shown in phantom line drawing in FIG. 4) corresponding to the separable contacts 14 (FIG. 3) being tripped open in response to the trip condition.

The trip actuator assembly 100 further includes a frame 106 having first and second opposing ends 108,110 and a mounting portion 112 disposed therebetween. The trip actuator 102 is disposed at or about the mounting portion 112 of the frame 106, as best shown in FIG. 2. The frame 106 also includes first and second trip actuator restraints 124,126, which in the example shown and described herein are a first projection 124 extending perpendicularly outwardly from the first end 108 of the frame 106 and a second projection 126 extending perpendicularly outwardly from the second end 110 of the frame 106, respectively. The second projection 126 is generally opposite the first projection 124 such that the trip actuator 102 is restrained between the first and second projections 124,126. The first projection 124 includes a tapered end 128, which is structured to cooperate (e.g., without limitation, conformingly fit together; nest) with a portion 22 of a corresponding one of the compartments 10 of the circuit breaker housing 4, as shown in FIG. 4. In this manner, the frame 106 secures the trip actuator assembly 100 in the desired orientation within the compartment 10 (e.g., bottom compartment 10 from the perspective of FIG. 3), with the mounting portion 112 of the frame 106 overlaying at least a portion of the trip actuator 102, as shown. That is, a first side 142 of the mounting portion 112 faces the trip actuator 102, and an opposing second side 144 faces the opposite direction toward the exterior 6 (FIGS. 3 and 4) of the circuit breaker housing 4 (FIGS. 3 and 4). A cavity 146, which also faces the exterior 6 of the circuit breaker housing 4, is formed in the second side 144, as shown in FIGS. 1-4. It will be appreciated that the top cover of the circuit breaker housing 4 has been removed in FIG. 3 to show internal structures of the circuit breaker 2.

An interface assembly 114 is movably coupled to the frame 106, and includes an interface element 116, which is disposed between the actuating element 104 of the trip actuator 102 and a portion (see, for example, trip bar plate 20 of FIG. 2, discussed hereinbelow) of the circuit breaker operating mechanism 16 (indicated generally by reference numeral 16 in FIG. 2; shown in simplified form in FIG. 3). When the actuating element 104 of the trip actuator 102 moves from the unactuated position (FIG. 2) toward the actuated position (partially shown in phantom line drawing in FIG. 4) in response to the trip condition, the actuating element 104 engages and moves the interface element 116, thereby moving (e.g., pivoting clockwise in the direction of arrow 30 from the perspective of FIG. 4) a trip bar 18 of the operating mechanism 16 to trip open the separable contacts 14 (FIG. 3). More specifically, the operating mechanism 16 of the example circuit breaker 2 includes a trip bar 18 and a generally planar element 20 (e.g., without limitation, a trip bar plate) extending outwardly from the trip bar 18, as best shown in FIG. 2. The interface element 116 of the interface assembly 114 includes an elongated protuberance 140 extending perpendicularly outwardly therefrom. Thus, when the actuating element 104 of the trip actuator 102 moves toward the actuated position in response to the trip condition, the elongated protuberance 140 engages and moves (e.g., to the right from the perspective of FIG. 4) the generally planar element 20, thereby pivoting (e.g., clockwise in the direction of arrow 30 from the perspective of FIG. 4) the trip bar 18. See, for example, the elongated protuberance 140 and trip bar plate 20 pivoted thereby, shown in phantom line drawing in FIG. 4. This, in turn, trips open the separable contacts 14 (FIG. 3) of the circuit breaker 2 (FIGS. 3 and 4).

The interface assembly 114 of the example trip actuator assembly 100 further includes a reset button 118, which is movably coupled to the frame 106 of the trip actuator assembly 100 at or about the second end 110 thereof. The reset member, which in the example shown and described herein is a reset button 118, includes a first end 120, which is accessible from the exterior 6 of the circuit breaker housing 4, as shown in FIGS. 3 and 4, and a second end 122, which is disposed opposite and distal from the first end 120. The second end 122 of the reset button 118 is cooperable with the aforementioned interface element 116 to reset the actuating element 104 of the trip actuator 102 from the actuated position (partially shown in phantom line drawing in FIG. 4) to the unactuated position (shown in solid line drawing in FIG. 4; see also FIG. 2). That is, the reset button 118 is movable among a first position (FIG. 4) corresponding to the second end 122 of the reset button 118 not engaging the interface element 116, and a second position (FIG. 2) corresponding to the second end 122 of the reset button 118 engaging and moving (e.g., to the left from the perspective of FIG. 2) the interface element 116, thereby moving the actuating element 104 of the trip actuator 102 in a like manner, towards (e.g., to the left from the perspective of FIG. 2) to its unactuated position (FIG. 2).

To facilitate the above operation upon actuation of the reset button 118, the interface element 116 includes an arcuate interface surface 134, and the second end 122 of the reset button 118 includes a corresponding arcuate actuating surface 136. When the reset button 118 is moved (e.g., downward from the perspective of FIG. 2) from the first position toward the second position of FIG. 2, the arcuate actuating surface 136 of the second end 122 of the reset button 118 engages the arcuate interface surface 134 of the interface element 116, and the two arcuate surfaces 134,136 cooperate to move (e.g., to the left from the perspective of FIG. 2) the interface element 116, thereby moving the actuating element 104 (FIGS. 1 and 4) of the trip actuator 102 toward its unactuated position.

As best shown in FIGS. 1 and 2, the interface assembly 114 further includes a biasing element 130 (e.g., without limitation, a spring), which biases the reset button 118 toward the first position of FIG. 4. In the example shown and described herein, the spring 130 is disposed between the first end 120 of the reset button 118, and a protrusion 132 (FIG. 1), which extends outwardly from the frame 106 proximate the second end 110 thereof. It will, however, be appreciated that any other known or suitable biasing element (not shown) could be employed in any suitable alternative manner (not shown) to bias the reset button 118.

Accordingly, the disclosed trip actuator assembly 100 provides a relatively compact sub-assembly, which fits in a desired orientation within a corresponding compartment 10 (FIGS. 3 and 4) of the circuit breaker housing 4 (FIGS. 3 and 4), yet provides an effective circuit breaker tripping device, for example and without limitation, for use with the trip unit module 200 (FIGS. 3 and 4).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A trip actuator assembly for an electrical switching apparatus, said electrical switching apparatus comprising a housing, separable contacts enclosed by the housing, and an operating mechanism structured to open and close said separable contacts, the housing including an exterior, an interior, and a number of compartments disposed within the interior, said trip actuator assembly comprising:

a trip actuator comprising an actuating element, the actuating element being structured to move among an unactuated position corresponding to said separable contacts of said electrical switching apparatus being closeable, and an actuated position corresponding to said separable contacts being tripped opened in response to a trip condition;

a frame comprising a first end, a second end disposed opposite and distal from the first end, and a mounting portion disposed between the first end and the second end, said trip actuator being disposed at or about the mounting portion of said frame;

an interface assembly movably coupled to said frame, said interface assembly comprising an interface element, said interface element being structured to be disposed between the actuating element of said trip actuator and a portion of said operating mechanism of said electrical switching apparatus ;

wherein, when the actuating element of said trip actuator moves from said unactuated position toward said actuated position in response to said trip condition, the actuating element engages and moves said interface element, thereby moving said operating mechanism to trip open said separable contacts;

wherein said frame is structured to secure said trip actuator assembly in a desired orientation within a corresponding one of said number of compartments of the housing;

wherein said interface assembly further comprises a reset member movably coupled to said frame; wherein said reset member includes a first end structured to be accessible from the exterior of the housing of said electrical switching apparatus, and a second end disposed opposite and distal from the first end of said reset member;

wherein the second end of said reset member is cooperable with said interface element to reset the actuating element of said trip actuator from said actuated position to said unactuated position;

wherein said reset member is a reset button; wherein said reset button is movable among a first position corresponding to the second end of said reset button not engaging said interface element, and a second position corresponding to the second end of said reset button engaging and moving said interface element, thereby moving the actuating element of said trip actuator toward said unactuated position; wherein said interface assembly further comprises a biasing element; and wherein said biasing element biases said reset button toward said first position; and wherein said biasing element is a spring; wherein said frame further comprises a protrusion extending outwardly from said frame proximate the second end of said frame; and wherein said spring is disposed between the protrusion of said frame and the first end of said reset button.

2. A trip actuator assembly for an electrical switching apparatus, said electrical switching apparatus comprising a housing, separable contacts enclosed by the housing, and an operating mechanism structured to open and close said separable contacts, the housing including an exterior, an interior, and a number of compartments disposed within the interior, said trip actuator assembly comprising:

a trip actuator comprising an actuating element, the actuating element being structured to move among an unactuated position corresponding to said separable contacts of said electrical switching apparatus being closeable, and an actuated position corresponding to said separable contacts being tripped opened in response to a trip condition;

a frame comprising a first end, a second end disposed opposite and distal from the first end, and a mounting portion disposed between the first end and the second end, said trip actuator being disposed at or about the mounting portion of said frame;

an interface assembly movably coupled to said frame, said interface assembly comprising an interface element, said interface element being structured to be disposed between the actuating element of said trip actuator and a portion of said operating mechanism of said electrical switching apparatus;

wherein, when the actuating element of said trip actuator moves from said unactuated position toward said actuated position in response to said trip condition, the actuating element engages and moves said interface element, thereby moving said operating mechanism to trip open said separable contacts;

wherein said frame is structured to secure said trip actuator assembly in a desired orientation within a corresponding one of said number of compartments of the housing, wherein said interface assembly further comprises a reset member movably coupled to said frame; wherein said reset member includes a first end structured to be accessible from the exterior of the housing of said electrical switching apparatus, and a second end disposed opposite and distal from the first end of said reset member;

wherein the second end of said reset member is cooperable with said interface element to reset the actuating element of said trip actuator from said actuated position to said unactuated position;

wherein said reset member is a reset button; wherein said reset button is movable among a first position corresponding to the second end of said reset button not engaging said interface element, and a second position corresponding to the second end of said reset button engaging and moving said interface element, thereby moving the actuating element of said trip actuator toward said unactuated position; wherein said interface assembly further comprises a biasing element; and wherein said biasing element biases said reset button toward said first position; and wherein said interface element includes an arcuate interface surface;

wherein the second end of said reset button includes an arcuate actuating surface; and wherein, when said reset button is moved from said first position toward said second position, the arcuate actuating surface of the second end of said reset button engages the arcuate interface surface of said interface element to move said interface element, thereby moving the actuating element of said trip actuator toward said unactuated position.

3. A trip actuator assembly for an electrical switching apparatus, said electrical switching apparatus comprising a housing, separable contacts enclosed by the housing, and an operating mechanism structured to open and close said separable contacts, the housing including an exterior, an interior, and a number of compartments disposed within the interior, said trip actuator assembly comprising:

a trip actuator comprising an actuating element, the actuating element being structured to move among an unactuated position corresponding to said separable contacts of said electrical switching apparatus being closeable, and an actuated position corresponding to said separable contacts being tripped opened in response to a trip condition;

a frame comprising a first end, a second end disposed opposite and distal from the first end, and a mounting portion disposed between the first end and the second end, said trip actuator being disposed at or about the mounting portion of said frame;

an interface assembly movably coupled to said frame, said interface assembly comprising an interface element, said interface element being structured to be disposed between the actuating element of said trip actuator and a portion of said operating mechanism of said electrical switching apparatus;

wherein, when the actuating element of said trip actuator moves from said unactuated position toward said actuated position in response to said trip condition, the actuating element engages and moves said interface element, thereby moving said operating mechanism to trip open said separable contacts;

wherein said frame is structured to secure said trip actuator assembly in a desired orientation within a corresponding one of said number of compartments of the housing;

wherein said frame further comprises a first trip actuator restraint and a second trip actuator restraint; wherein said trip actuator is restrained between said first trip actuator restraint and said second trip actuator restraint; and wherein the mounting portion of said frame overlays at least a portion of said trip actuator; and wherein said first trip actuator restraint is a first projection extending perpendicularly outwardly from the first end of said frame; and wherein said second trip actuator restraint is a second projection extending perpendicularly outwardly from the second end of said frame generally opposite said first projection.

4. The trip actuator assembly of claim 3 wherein said first projection includes a tapered end; and wherein the tapered end of said first projection is structured to cooperate with a portion of said corresponding one of said number of compartments of the housing of said electrical switching apparatus.

5. An electrical switching apparatus comprising:

a housing including an exterior, an interior, and a number of compartments disposed within the interior;

separable contacts enclosed by the housing;

an operating mechanism for opening and closing said separable contacts;

a trip actuator assembly comprising:

a trip actuator comprising an actuating element, the actuating element being movable among an unactuated position corresponding to said separable contacts being closeable, and an actuated position corresponding to said separable contacts being tripped opened in response to a trip condition;

a frame comprising a first end, a second end disposed opposite and distal from the first end, and a mounting portion disposed between the first end and the second end, said trip actuator being disposed at or about the mounting portion of said frame;

an interface assembly movably coupled to said frame, said interface assembly comprising an interface element, said interface element being disposed between the actuating element of said trip actuator and a portion of said operating mechanism;

wherein, when the actuating element of said trip actuator moves from said unactuated position toward said actuated position in response to said trip condition, the actuating element engages and moves said interface element, thereby moving said operating mechanism to trip open said separable contacts;

wherein said frame secures said trip actuator assembly in a desired orientation within a corresponding one of said number of compartments of the housing;

wherein said interface assembly of said trip actuator assembly further comprises a reset member movably coupled to said frame; wherein said reset member includes a first end and a second end disposed opposite and distal from the first end of said reset member; wherein the first end of said reset member is accessible from the exterior of the housing of said electrical switching apparatus; wherein the second end of said reset member is cooperable with said interface element to reset the actuating element of said trip actuator from said actuated position to said unactuated position;

wherein said reset member is a reset button; wherein said reset button is movable among a first position corresponding to the second end of said reset button not engaging said interface element, and a second position corresponding to the second end of said reset button engaging and moving said interface element, thereby moving the actuating element of said trip actuator toward said unactuated position; wherein said interface assembly further comprises a biasing element; and wherein said biasing element biases said reset button toward said first position; and wherein said interface element of said interface assembly includes an arcuate interface surface; wherein the second end of said reset button includes an arcuate actuating surface; and wherein, when said reset button is moved from said first position toward said second position, the arcuate actuating surface of the second end of said reset button engages the arcuate interface surface of said interface element to move said interface element, thereby moving the actuating element of said trip actuator toward said unactuated position.

6. An electrical switching apparatus comprising:

a housing including an exterior, an interior, and a number of compartments disposed within the interior;

separable contacts enclosed by the housing;

an operating mechanism for opening and closing said separable contacts;

a trip actuator assembly comprising:

a trip actuator comprising an actuating element, the actuating element being movable among an unactuated position corresponding to said separable contacts being closeable, and an actuated position corresponding to said separable contacts being tripped opened in response to a trip condition;

a frame comprising a first end, a second end disposed opposite and distal from the first end, and a mounting portion disposed between the first end and the second end, said trip actuator being disposed at or about the mounting portion of said frame;

an interface assembly movably coupled to said frame, said interface assembly comprising an interface element, said interface element being disposed between the actuating element of said trip actuator and a portion of said operating mechanism;

wherein, when the actuating element of said trip actuator moves from said unactuated position toward said actuated position in response to said trip condition, the actuating element engages and moves said interface element, thereby moving said operating mechanism to trip open said separable contacts;

wherein said frame secures said trip actuator assembly in a desired orientation within a corresponding one of said number of compartments of the housing;

wherein said frame of said trip actuator assembly further comprises a first trip actuator restraint and a second trip actuator restraint; wherein said trip actuator is restrained between said first trip actuator restraint and said second trip actuator restraint; and wherein the mounting portion of said frame overlays at least a portion of said trip actuator; and wherein said first trip actuator restraint is a first projection extending perpendicularly outwardly from the first end of said frame; and wherein said second trip actuator restraint is a second projection extending perpendicularly outwardly from the second end of said frame generally opposite said first projection.

7. The electrical switching apparatus of claim 6 wherein said first projection includes a tapered end; and wherein the tapered end of said first projection cooperates with a portion of said corresponding one of said number of compartments of the housing of said electrical switching apparatus to maintain said desired orientation of said trip actuator assembly.

8. An electrical switching apparatus comprising:

a housing including an exterior, an interior, and a number of compartments disposed within the interior;

separable contacts enclosed by the housing;

an operating mechanism for opening and closing said separable contacts;

a trip actuator assembly comprising:

a trip actuator comprising an actuating element, the actuating element being movable among an unactuated position corresponding to said separable contacts being closeable, and an actuated position corresponding to said separable contacts being tripped opened in response to a trip condition;

a frame comprising a first end, a second end disposed opposite and distal from the first end, and a mounting portion disposed between the first end and the second end, said trip actuator being disposed at or about the mounting portion of said frame;

an interface assembly movably coupled to said frame, said interface assembly comprising an interface element, said interface element being disposed between the actuating element of said trip actuator and a portion of said operating mechanism;

wherein, when the actuating element of said trip actuator moves from said unactuated position toward said actuated position in response to said trip condition, the actuating element engages and moves said interface element, thereby moving said operating mechanism to trip open said separable contacts;

wherein said frame secures said trip actuator assembly in a desired orientation within a corresponding one of said number of compartments of the housing; and wherein the mounting portion of said frame of said trip actuator assembly includes a first side facing said trip actuator and a second side disposed opposite the first side; wherein the second side of the mounting portion forms a cavity; and wherein said cavity faces the exterior of the housing of said electrical switching apparatus.

9. An electrical switching apparatus comprising:

a housing including an exterior, an interior, and a number of compartments disposed within the interior;

separable contacts enclosed by the housing;

an operating mechanism for opening and closing said separable contacts;

a trip actuator assembly comprising:

a trip actuator comprising an actuating element, the actuating element being movable among an unactuated position corresponding to said separable contacts being closeable, and an actuated position corresponding to said separable contacts being tripped opened in response to a trip condition;

a frame comprising a first end, a second end disposed opposite and distal from the first end, and a mounting portion disposed between the first end and the second end, said trip actuator being disposed at or about the mounting portion of said frame;

an interface assembly movably coupled to said frame, said interface assembly comprising an interface element, said interface element being disposed between the actuating element of said trip actuator and a portion of said operating mechanism;

wherein, when the actuating element of said trip actuator moves from said unactuated position toward said actuated position in response to said trip condition, the actuating element engages and moves said interface element, thereby moving said operating mechanism to trip open said separable contacts;

wherein said frame secures said trip actuator assembly in a desired orientation within a corresponding one of said number of compartments of the housing; and wherein said electrical switching apparatus is a circuit breaker;

wherein said operating mechanism of said circuit breaker further comprises a trip unit module; wherein said trip unit module comprises a sensor structured to sense current flowing through said separable contacts, and a processor structured to output a trip signal to said trip actuator of said trip actuator assembly responsive to said sensed current; and wherein, when said sensed current is indicative of said trip condition, said trip signal actuates the actuating element of said trip actuator thereby moving the actuating element to said actuated position to trip open said separable contacts.

* * * * *